US005115662A

United States Patent [19]

Relich et al.

[11] Patent Number: 5,115,662

[45] Date of Patent: May 26, 1992

[54] APPARATUS FOR STRIPPING WORKPIECES

[75] Inventors: Nick P. Relich, Littleton; Roger A. Hahn, Arvada; Cook, Jr. Harold, Evergreen, all of Colo.

[73] Assignee: Coors Brewing Company, Golden, Colo.

[21] Appl. No.: 724,742

[22] Filed: Jul. 2, 1991

[51] Int. Cl.[5] ..... B21D 45/08

[52] U.S. Cl. ..... 72/345

[58] Field of Search ..... 72/344, 345

[56] References Cited

U.S. PATENT DOCUMENTS 3,935,724 2/1976 Finsterwalder et al. ..... 72/345
3,990,289 11/1976 Widmann et al. .
4,121,447 10/1978 Sniady ..... 72/344
4,606,215 9/1986 McMillin .

FOREIGN PATENT DOCUMENTS 1532161 12/1989 U.S.S.R. ..... 72/344

*Primary Examiner*—Lowell A. Larson
*Attorney, Agent, or Firm*—Klaas, Law, O'Meara & Malkin

[57] ABSTRACT

Apparatus for stripping a cylindrical workpiece, such as a can body, from a cylindrical supporting device, such as a punch of a can body making machine, using a plurality of pivotally mounted fingers which are mounted between a non-stripping location so that the cylindrical workpiece and the cylindrical supporting device may pass through the stripping fingers without contacting the stripping fingers and a stripping location whereat the stripping fingers will contact the leading edge of the cylindrical workpiece to disengage it from the punch and wherein the stripping fingers are formed from a magnetically conductive material and are moved into the stripping location by electromagnetic apparatus.

20 Claims, 2 Drawing Sheets

APPARATUS FOR STRIPPING WORKPIECES

FIELD OF THE INVENTION

This invention relates generally to apparatus for stripping a cylindrical workpiece from a cylindrical supporting device and, more particularly, to apparatus for stripping a one-piece can body from the punch of a can body making machine during the return stroke of the punch.

BACKGROUND OF THE INVENTION

Conventional can body making machines employ a removable tool pack assembly and a removable stripper assembly which are removably mounted in a forming cavity of the machine. Conventional stripper assemblies comprise an annular ring support structure mounting a plurality of separate circumferentially spaced apart fingers to form a generally circular opening. The fingers are mounted to provide for individual radially inward or outward movement. In some instances the fingers are resiliently urged against the outer surface of the punch during the return stroke so as to contact the leading edge of the can body to disengage it from the punch. In other instances, the fingers are located not to contact the can body on the forward stroke but then are moved to be spaced a very small distance from the outer surface of the punch so that during the return stroke of the punch the fingers contact the leading edge of the can body to disengage it from the punch.

BRIEF DESCRIPTION OF THE INVENTION

This invention provides apparatus for stripping a cylindrical workpiece, such as a can body, from a cylindrical supporting device, such as a punch of a can body making machine, on which the cylindrical workpiece is supported using a plurality of stripping fingers which are pivotally mounted for movement between a non-stripping location so that the cylindrical workpiece and the cylindrical supporting device may pass through the stripping fingers without contacting the stripping fingers and a stripping location whereat, during the return stroke of the cylindrical supporting device, the resilient fingers will contact the leading edge of the cylindrical workpiece to disengage it from the cylindrical supporting device.

In the normal operation of a can body forming machine, the cylindrical workpiece and the cylindrical supporting device are moved through the stripping apparatus in a forward stroke thereof and during the return stroke the cylindrical workpiece has a leading end to enhance disengagement thereof from the cylindrical supporting device. In a preferred embodiment of the invention, housing means are used for supporting the stripping apparatus circumjacent to the cylindrical workpiece and the cylindrical supporting device. A plurality of circumferentially spaced apart stripping fingers are pivotally mounted in a housing means. Pivot means are provided for mounting the stripping fingers for pivotal movement around axes extending transverse to the direction of movement of the cylindrical workpiece and the cylindrical supporting device for pivotal movement between a non-stripping location whereat the cylindrical workpiece and the cylindrical supporting device may pass through the stripping fingers without contacting the stripping fingers and a stripping location whereat the stripping fingers will contact the leading end of the cylindrical workpiece to strip the cylindrical workpiece from the cylindrical supporting device. Resilient means are provided for urging the stripping fingers into the stripping position. Force applying means mounted in the housing means apply a force to each of the stripping fingers to move the stripping fingers into the non-stripping location. The force applying means comprise electromagnetic means. The electromagnetic means comprise an annular recess in the housing means having its open end facing in the direction of movement of the cylindrical supporting device in its forward stroke, an annular U-shaped member formed from a magnetically conductive material mounted in the annular recess and having its open end facing in the direction of movement of the cylindrical supporting device in its forward stroke and an annular coil formed from an electrical conducting material and contained in a non-magnetic material mounted in the U-shaped member. Each of the stripping fingers is formed from a magnetically conductive material and has an annular portion thereof located to be moved into contacting relationship with the electromagnetic means when the annular coil is electrically energized. The housing means are formed from a non-magnetic material. Adjustable stop means are provided for holding the annular portion close to but spaced from the electromagnetic means.

The pivot means comprise an annular recess formed in the housing means. An annular projection is provided on the housing means and projects radially outwardly into the recess and has a rounded outer surface. Each of the stripping fingers has an inner surface having an arcuate recess which extends radially outwardly therefrom and has an inner surface for contacting the outer surface of the annular projection. The inner and outer surfaces have surface configurations for permitting the stripping finger to pivot on the outer surface. The resilient means also urge the inner surface against the outer surface. Each of the stripping fingers has an arcuate recess formed in its outer surface and a portion of the resilient means is seated in the arcuate recess. The resilient means comprise an O-ring in a compressed state when seated in the arcuate recesses of the stripping fingers.

In another preferred embodiment of the invention, a second electromagnetic means is used instead of the resilient means to move the stripping fingers into the stripping location. The second electromagnetic means are located in an annular recess in the adjusting means and act on the annular portion of each of the stripping fingers. The annular recess has its open end facing in the direction of movement of the cylindrical supporting device during its return stroke.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
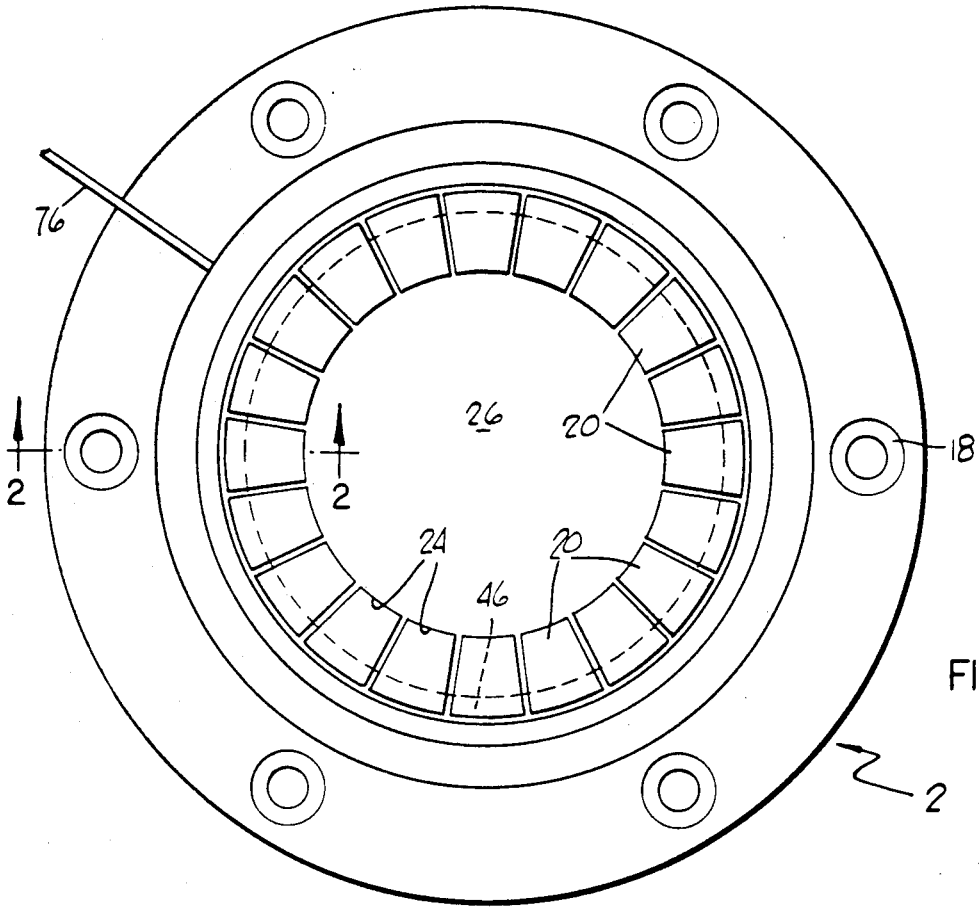
FIG. 1 is a top plan view of the housing means for the stripping apparatus for one preferred embodiment of the invention.
Figure 2:
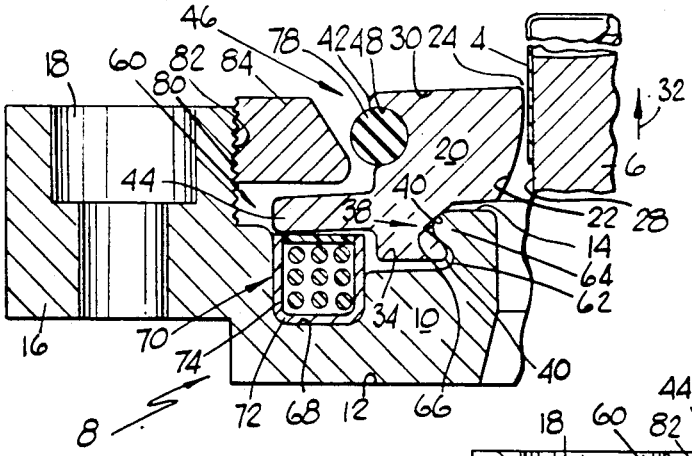
FIG. 2 is a cross-sectional view taken on the line 2—2 of FIG. 1 and illustrating a stripping finger in the non-stripping location.
Figure 3:
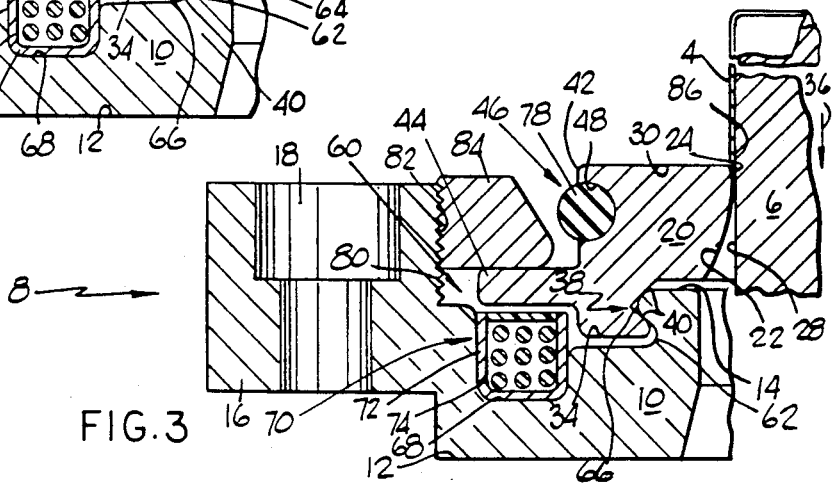
FIG. 3 is a cross-sectional view taken on the line 2—2 of FIG. 1 and illustrating a stripping finger in the stripping location.

In FIGS. 1-3, there is illustrated one preferred embodiment of apparatus 2 for stripping a cylindrical workpiece 4, such as a can body, from a cylindrical supporting device 6, such as a punch of a conventional can body making machine. The apparatus 2 has housing means 8 comprising an annular member having a body portion 10 having oppositely facing surfaces 12 and 14. An integral flange portion 16 extends radially outwardly from the body portion 10 and has a plurality of openings 18 which are circumferentially equally spaced apart to provide passageways for threaded bolts (not shown) to mount the housing means 8 on a can body making machine (not shown) so that the housing means 8 are circumjacent the cylindrical workpiece 4 and the cylindrical supporting device 6. The housing means 8 is formed from a non-magnetic material, such as 300 series stainless steel.

A plurality of a stripping fingers 20 are provided and preferably are equally sized and circumferentially equally spaced apart and have radially inner surfaces 22 having arcuate inner surface portions 24 so as to form a generally circular opening 26. The arcuate inner surface portion 24 is an arc of a circle having a radius which is substantially equal to the radius of the outer surface 28 of the cylindrical supporting device 6. Each stripping finger 20 has a generally planar surface 30 facing in the direction of movement of the cylindrical supporting device 6 in its forward stroke as indicated by the arrow 32 and an axially spaced apart generally planar surface 34 facing in the direction of movement of the cylindrical supporting device 6 in its return stroke as indicated by the arrow 36. A radially outwardly extending recess 38 is formed in the radially inner surface 22 and has angularly related linearly extending wall portions 40 which are also arcuately shaped in a circumferentially direction for a purpose described below. Each stripping finger 20 has a radially outer surface 42 having an integral flange portion 44 projecting radially outwardly from the radially outer surface 42 and a radially inwardly extending recess 46 having a rounded wall portion 48 which is also arcuately shaped in the circumferentially direction for purposes described below. Each stripping finger 20 is formed from a magnetically conductive material, such as tool steel.

An annular recess 60 is formed in the surface 14 and has a first annular portion 62 formed by a radially outwardly projecting flange portion 64, FIG. 2, having a rounded wall portion 66 which is also arcuately shaped in the circumferential direction. As illustrated in FIGS. 2 and 3, the wall portions 40 are in contact with the wall portion 66 to provide for a pivotal mounting of each stripping finger 20. A second annular portion 68 of the annular recess 60 has an opening facing in the direction of movement of the cylindrical supporting device 6 in its forward stroke. First electromagnetic means 70 are seated in the second annular portion 68 and comprise a generally U-shaped member 72 formed from a magnetically conductive material, such as low carbon steel, and having its open end facing in the direction of movement of the generally cylindrical supporting device 6 in its forward stroke. An electromagnetic coil 74 embedded in a material, such as an epoxy resin, is seated in the U-shaped member 72 and has electrical leads 76 connected to electrical control means (not shown) for activating the electromagnetic means 70. The second annular portion 68 is located so that at least a portion of the flange portion 44 is in juxtaposed relationship with the electromagnetic means 70. A resilient O-ring 78, formed from nitrile or buna and having a Shore A durometer of between about 60 and 80, is seated in an annual groove formed by the rounded wall portions 48 of the stripping fingers 20 and urges the stripping fingers 20 to pivot in a radially inward direction The housing means 8 has an internally threaded portion 80 adapted to receive the externally threaded portion 82 of an adjustment nut 84 to limit the radially inward movement of the stripping fingers 20. The adjustment nut 84 is formed from a non-magnetic material, such as 300 series stainless steel.

In operation, the stripping fingers 20 will be urged by the resilient O-ring 78 in a radially inward direction as limited by the adjustment nut 84 so that the arcuate inner surface portions 24 form a circle having a radius that is slightly less than the radius of the outer surface 28 of the cylindrical supporting device 6 so that when the cylindrical supporting device 6 is radially opposite to the stripping fingers 20, the arcuate inner surface portions 24 will be resiliently urged against the outer surface 28 in a stripping location. As the cylindrical workpiece 4 and the cylindrical supporting device 6 move in the forward stroke, an encoder driven by the bodymaker crankshaft (not shown) will signal the electrical control means to activate the first electromagnetic means 70 to move the flange portion 44 against the first electromagnetic means 70 so that the stripping fingers 20 move generally in a radially outward direction to a non-stripping location whereat the opening 26 formed by the arcuate inner surface portions 24 and the radially inner surfaces 22 have a radius greater than the radius of the cylindrical workpiece 4 so that the cylindrical workpiece 4 and the cylindrical supporting device 6 will move through the stripping apparatus 2 without contacting the stripping fingers 20. After the cylindrical workpiece 4 has moved through the stripping apparatus 2, the encoder will signal the electrical control means to deactivate the electromagnetic means 70 so that the resilient O-ring 78 will move the stripping fingers 20 radially inwardly so that the arcuate inner surface portions 24 are in resilient contact with the outer surface 28. Therefore, as the cylindrical workpiece 4 and the cylindrical supporting device 6 move in the return stroke, the leading end surface 86 of the cylindrical workpiece 4 will contact the stripping fingers 20 and be stripped from the cylindrical supporting device 6.

Figure 4:
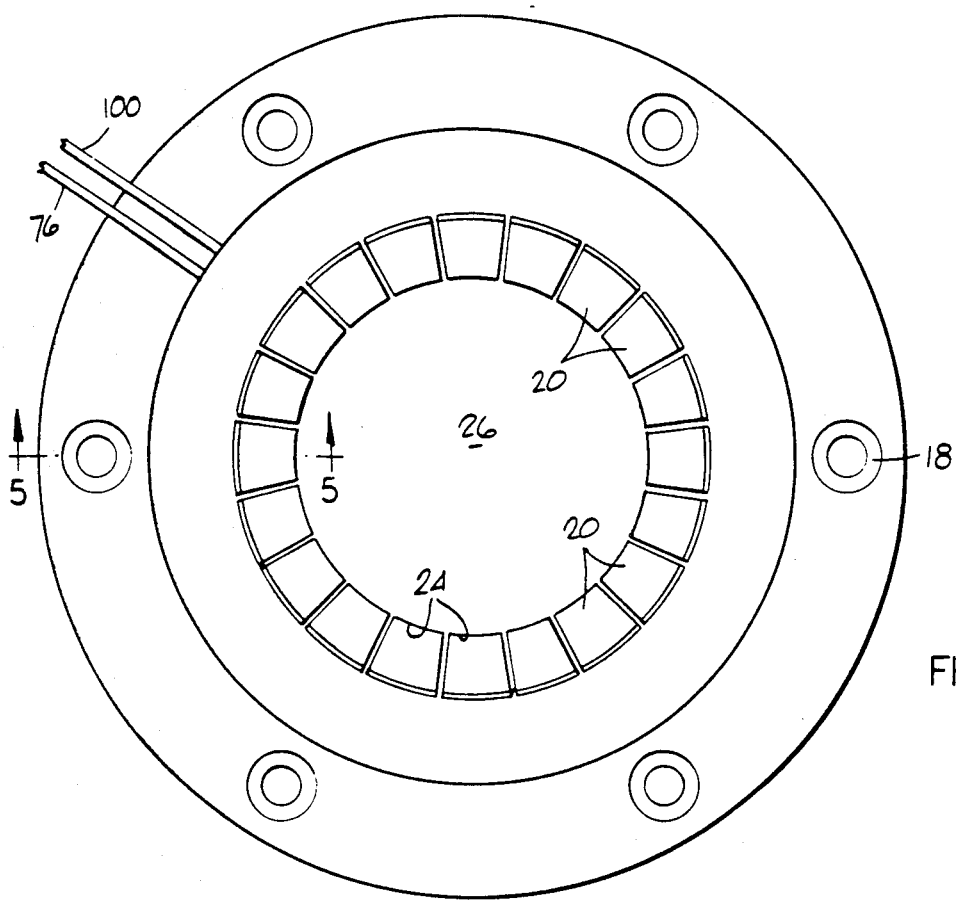
FIG. 4 is a top plan view of the housing means for the stripping apparatus for another preferred embodiment of the invention.
Figure 5:
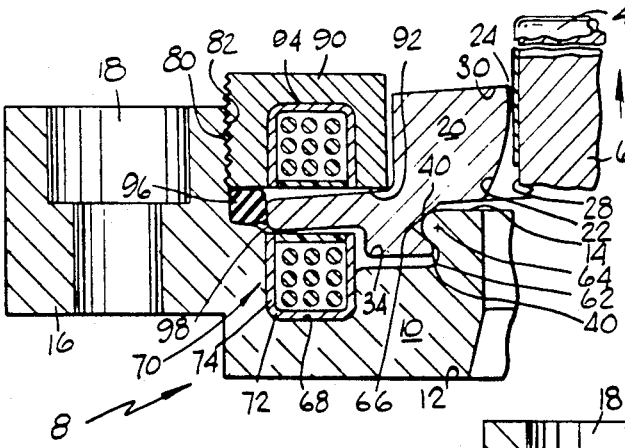
FIG. 5 is a cross-sectional view taken on the line 5—5 of FIG. 4 and illustrating a stripping finger in the non-stripping location.
Figure 6:
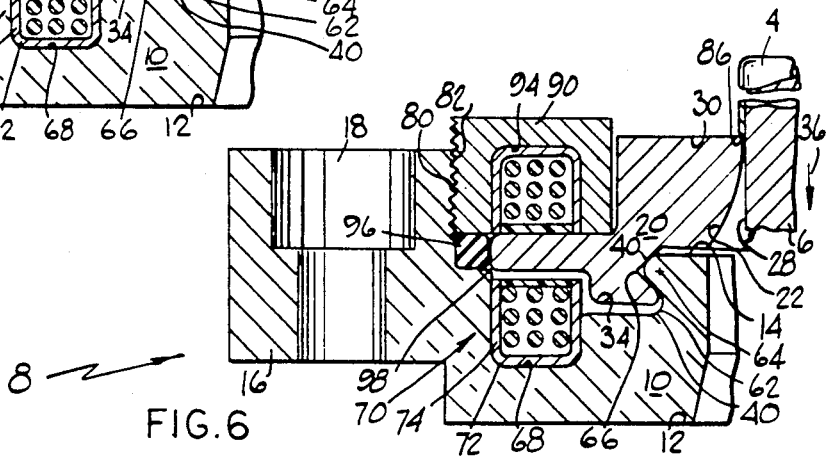
FIG. 6 is a cross-sectional view taken on the line 5—5 of FIG. 4 and illustrating a stripping finger in the stripping location.

Another preferred embodiment of the invention is illustrated in FIGS. 4-6 where parts corresponding to those described above in reference to FIGS. 1-3 will be given the same reference numeral and will not be described again. The adjustment nut 90 is shaped differently from the adjustment nut 84 and has a generally planar surface 92 facing the flange portion 44. An annular recess 94 is formed in the surface 92 and has an opening facing in the direction of movement of the cylindrical supporting device 6 in its return stroke 36. Second electromagnetic means 70 are seated in the annular recess 94 and the generally U-shaped member 72 has its open end facing in the direction of movement of the cylindrical supporting device 6 in its return stroke. A resilient annular O-ring 96, formed from nitrileor buna and having a Shore A durometer of between about 60 and 80, is located between the surfaces 14 and 92 and is dimensioned to apply a resilient force on the end surface 98 of the flange portion 44 to urge the wall portions 40 against the rounded wall portion 66 to provide for the pivotal mounting of the stripping fingers 20. Electrical leads 100 connected to electrical control means (not shown) are provided for activating the second electromagnetic means 70.

In operation, the stripping fingers 20 will be urged into the pivotal mounting, as described above, by the resilient annular O-ring 96. As the cylindrical workpiece 4 and the cylindrical supporting device 6 move in the forward stroke, an encoder (not shown) in the cylindrical supporting device will signal the electrical control means to activate the first electromagnetic means 70 to move the flange portion 44 against the first electromagnetic means 70 so that the stripping fingers 20 move generally in a radially outward direction to a non-stripping location whereat the opening 26 formed by the arcuate inner surface portions 24 and the radially inner surfaces 22 have a radius greater than the radius of the cylindrical workpiece 4 so that the cylindrical workpiece 4 and the cylindrical supporting device 6 will move through the stripping apparatus 2 without contacting the stripping fingers 20. After the cylindrical workpiece 4 has moved through the stripping apparatus 2, the encoder will signal the electrical control means to deactivate the first electromagnetic means 70 and to activate the second electromagnetic means 70 to move the flange portion toward the second electromagnetic means 70 to move the stripping fingers 20 radially inward so that the arcuate inner surface portions 24 are in contact with the outer surface 28. When the arcuate inner surface portions 24 contact the outer surface 28 to stop the movement thereof, the flange portion 44 will be spaced a small distance from the second electromagnetic means 70. Therefore, as the cylindrical workpiece 4 and the cylindrical supporting device 6 move in the return stroke, the leading end surface 86 of the cylindrical workpiece 4 will contact the stripping fingers 20 and be stripped from the cylindrical supporting device 6.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for stripping a cylindrical workpiece from a reciprocating cylindrical supporting device having a forward and a return stroke and on which the cylindrical workpiece is supported so as to have a leading end surface during the return stroke comprising:

housing means for supporting the apparatus circumjacent the cylindrical workpiece and the cylindrical supporting device;

a plurality of circumferentially spaced apart stripping fingers pivotally mounted in said housing means;

pivot means for mounting said stripping fingers for pivotal movement around axes extending transverse to the direction of movement of said cylindrical workpiece and said cylindrical supporting device for pivotal movement between a non-stripping location whereat said cylindrical workpiece and said cylindrical supporting device may pass through said stripping fingers without contacting said stripping fingers and a stripping location whereat said stripping fingers will contact said leading end of the cylindrical workpiece to strip said cylindrical workpiece from said cylindrical supporting device;

resilient means for moving said stripping fingers into said stripping position; and force applying means mounted in said housing means to apply a force to each of said stripping fingers to move said stripping fingers into said non-stripping location.

2. Apparatus as in claim 1 wherein:

said stripping fingers are in contacting relationship with said cylindrical supporting device when in said stripping location.

3. Apparatus as in claim 1 wherein:

said force applying means comprises an electromagnetic means.

4. Apparatus as in claim 3 wherein said electromagnetic means comprise:

an annular recess in said housing having its open end facing in the direction of movement of said cylindrical supporting device in its forward stroke;

an annular U-shaped member formed from a magnetically conductive material mounted in said annular recess and having its open end facing in the direction of movement of said cylindrical supporting device in its forward stroke;

an annular coil formed from an electrical conducting material mounted in said U-shaped member;

said annular coil contained in a non-magnetic material having an exposed surface;

each of said stripping fingers formed from a magnetically conductive material and having an annular portion thereof located to be moved into contacting relationship with said electromagnetic means when said annular coil is electrically energized; an said housing means being formed from a non-magnetic material.

5. Apparatus as in claim 4 and further comprising:

adjustable stop means for limiting the movement of said stripping fingers to retain said annular portion close to but spaced from said electromagnetic means.

6. Apparatus as in claim 1 wherein said pivot means comprise:

an annular recess formed in said housing means;

an annular projection on said housing means projecting radially outwardly into said recess and having an outer surface;

each of said stripping fingers having an inner surface having an annular recess extending radially outwardly therefrom and having an inner surface for contacting said outer surface;

said inner and outer surfaces having surface configurations for permitting said stripping finger to pivot on said outer surface; and said resilient means urging said inner surface against said outer surface.

7. Apparatus as in claim 6 and further comprising:

each of said stripping fingers having an arcuate recess formed therein; and a portion of said resilient means seated in said arcuate recess.

8. Apparatus a in claim 7 wherein:

said resilient means comprising an O-ring in a compressed state when seated in said recesses of said stripping fingers.

9. Apparatus as in claim 8 wherein:

said force applying means comprises an electromagnetic means.

10. Apparatus as in claim 9 wherein said electromagnetic means comprises:

an annular recess in said housing having its open end facing in the direction of movement of said cylindrical supporting device in its forward stroke;

an annular U-shaped member formed from a magnetically conductive material mounted in said annular recess and having its open end facing in the direction of movement of said cylindrical supporting device in its forward stroke;

an annular coil formed from an electrical conducting material mounted in said U-shaped member;

said annular coil contained in a non-magnetic material having an exposed surface;

each of said stripping fingers formed from a magnetically conductive material and having an annular portion thereof located to be moved into contacting relationship with said electromagnetic means when said annular coil is electrically energized; and said housing means being formed from a non-magnetic material.

11. Apparatus for stripping a cylindrical workpiece from a reciprocating cylindrical supporting device having a forward and a return stroke and on which the cylindrical workpiece is supported so as to have a leading end surface during the return stroke comprising:

housing means for supporting the apparatus circumjacent the cylindrical workpiece and the cylindrical supporting device;

a plurality of circumferentially spaced apart stripping fingers pivotally mounted in said housing means;

pivot means for mounting said stripping fingers for pivotal movement around axes extending transverse to the direction of movement of said cylindrical workpiece and said cylindrical supporting device for pivotal movement between a non-stripping location whereat said cylindrical workpiece and said cylindrical supporting device may pass through said stripping fingers without contacting said stripping fingers and a stripping location whereat said stripping fingers will contact said leading end of the cylindrical workpiece to strip said cylindrical workpiece from said cylindrical supporting device;

first electromagnetic means for applying a force on said stripping fingers to move said stripping fingers to said non-stripping location; and second electromagnetic means for applying a force on said stripping fingers to move said stripping fingers to said stripping location.

12. Apparatus as in claim 11 wherein:

said stripping fingers are in contacting relationship with said cylindrical supporting device when in said stripping location.

13. Apparatus as in claim 11 wherein said first electromagnetic means comprise:

an annular recess in said housing having its open end facing in the direction of movement of said cylindrical supporting device in its forward stroke;

an annular U-shaped member formed from a magnetically conductive material mounted in said annular recess and having its open end facing in the direction of movement of said cylindrical supporting device in its forward stroke;

an annular coil formed from an electrical conducting material mounted in said U-shaped member;

said annular coil contained in a non-magnetic material having an exposed surface;

each of said stripping fingers formed from a magnetically conductive material and having an annular portion thereof located to be moved into contacting relationship with said electromagnetic means when said annular coil is electrically energized; and said housing means being formed from a non-magnetic material.

14. Apparatus as in claim 11 and further comprising:

adjustable stop means for limiting the movement of said stripping fingers to retain said annular portion close to but spaced from said first electromagnetic means.

15. Apparatus as in claim 14 wherein said first electromagnetic means comprise:

an annular recess in said housing having its open end facing in the direction of movement of said cylindrical supporting device in its forward stroke;

an annular U-shaped member formed from a magnetically conductive material mounted in said annular recess and having its open end facing in the direction of movement of said cylindrical supporting device in its forward stroke;

an annular coil formed from an electrical conducting material mounted in said U-shaped member;

said annular coil contained in a non-magnetic material having an exposed surface;

each of said stripping fingers formed from a magnetically conductive material and having an annular portion thereof located to be moved into contacting relationship with said electromagnetic means when said annular coil is electrically energized; and said housing means being formed from a non-magnetic material.

16. Apparatus as in claim 15 wherein said second electromagnetic means comprise:

an annular groove in said adjustable stop means having its open end facing in the direction of movement of said cylindrical supporting device in its return stroke;

an annular U-shaped member formed from a magnetically conductive material mounted in said annular recess and having its open end facing in the direction of movement of said cylindrical supporting device in its forward stroke;

an annular coil formed from an electrical conducting material mounted in said U-shaped member;

said annular coil contained in a non-magnetic material having an exposed surface;

each of said stripping fingers formed from a magnetically conductive material and having an annular portion thereof located to be moved into contacting relationship with said electromagnetic means when said annular coil is electrically energized; and said adjustable stop means being formed from a non-magnetic material.

17. Apparatus as in claim 11 wherein said pivot means comprises:

an annular recess formed in said housing means;

an annular projection on said housing means projecting radially outwardly into said recess and having an outer surface;

each of said stripping fingers having an outer surface having an annular recess extending radially outwardly therefrom and having an inner surface for contacting said outer surface;

said inner and outer surfaces having surface configurations for permitting said stripping finger to pivot on said outer surface; and resilient means urging said inner.surface against said outer surface.

18. Apparatus as in claim 17 wherein said first electromagnetic means comprise:

an annular recess in said housing having its open end facing in the direction of movement of said cylindrical supporting device in its forward stroke;

an annular U-shaped member formed from a magnetically conductive material mounted in said annular recess and having its open end facing in the direction of movement of said cylindrical supporting device in its forward stroke;

an annular coil formed from an electrical conducting material mounted in said U-shaped member;

said annular coil contained in a non-magnetic material having an exposed surface;

each of said stripping fingers formed from a magnetically conductive material and having an annular portion thereof located to be moved into contacting relationship with said electromagnetic means when said annular coil is electrically energized; and said housing means being formed from a non-magnetic material.

19. Apparatus as in claim 18 and further comprising:

adjustable stop means for limiting the movement of said stripping fingers to retain said annular portion close to but spaced from said electromagnetic means.

20. Apparatus as in claim 19 and wherein said second electromagnetic means comprise:

an annular groove in said adjustable stop means having its open end facing in the direction of movement of said cylindrical supporting device in its return stroke;

an annular U-shaped member formed from a magnetically conductive material mounted in said annular recess and having its open end facing in the direction of movement of said cylindrical supporting device in its forward stroke;

an annular coil formed from an electrical conducting material mounted in said U-shaped member;

said annular coil contained in a non-magnetic material having an exposed surface;

each of said stripping fingers formed from a magnetically conductive material and having an annular portion thereof located to be moved into contacting relationship with said electromagnetic means when said annular coil is electrically energized; and said adjustable stop means being formed from a non-magnetic material.

* * * * *